US007604157B2

(12) United States Patent
Zammit et al.

(10) Patent No.: US 7,604,157 B2
(45) Date of Patent: Oct. 20, 2009

(54) CARTON WITH DISPENSER

(75) Inventors: Mark Zammit, Hiram, GA (US); Charles F. Ho Fung, Woodstock, GA (US); Jean-Manuel Gomes, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 11/767,141

(22) Filed: Jun. 22, 2007

(65) Prior Publication Data

US 2007/0295790 A1 Dec. 27, 2007

Related U.S. Application Data

(60) Provisional application No. 60/815,977, filed on Jun. 23, 2006.

(51) Int. Cl.
*B65D 17/28* (2006.01)

(52) U.S. Cl. ..... 229/240; 229/122; 229/242

(58) Field of Classification Search ..... 229/240, 229/242, 122; 206/427; 221/302–305
See application file for complete search history.

(56) References Cited

U.S. PATENT DOCUMENTS

| | | | | |
|---|---|---|---|---|
| 1,925,102 | A | | 9/1933 | Levkoff |
| 2,005,924 | A | | 6/1935 | Wilson |
| 2,067,749 | A | | 1/1937 | Zimmerman et al. |
| 2,115,673 | A | | 4/1938 | Stompe |
| 2,299,027 | A | | 10/1942 | Novak |
| 2,669,351 | A | | 2/1954 | Carson et al. |
| 2,754,047 | A | | 7/1956 | Schmidt et al. |
| 3,078,032 | A | | 2/1963 | Robinson et al. |
| 3,128,010 | A | | 4/1964 | Forrer |
| 3,133,634 | A | | 5/1964 | Bozdar |
| 3,178,242 | A | | 4/1965 | Ellis et al. |
| 3,228,582 | A | | 1/1966 | Osberg |
| 3,263,861 | A | | 8/1966 | Carr |
| 3,265,283 | A | | 8/1966 | Farquhar |
| 3,300,115 | A | * | 1/1967 | Schauer ..... 221/305 |
| 3,332,594 | A | | 7/1967 | De Capua |
| 3,346,167 | A | | 10/1967 | Schmidt |
| 3,356,279 | A | | 12/1967 | Root |
| 3,517,858 | A | | 6/1970 | Farquhar |
| 3,533,549 | A | * | 10/1970 | Gilchrist ..... 229/242 |
| 3,540,581 | A | | 11/1970 | Koolnis |
| 4,155,449 | A | | 5/1979 | Bryne |
| 4,214,660 | A | | 7/1980 | Hunt, Jr. |
| 4,222,485 | A | | 9/1980 | Focke |
| 4,256,226 | A | | 3/1981 | Stone |
| 4,318,474 | A | | 3/1982 | Hasegawa |
| 4,364,509 | A | | 12/1982 | Holley, Jr. et al. |
| 4,375,258 | A | | 3/1983 | Crayne et al. |
| 4,376,509 | A | | 3/1983 | Schaffer |
| 4,378,877 | A | | 4/1983 | Botterman et al. |

(Continued)

FOREIGN PATENT DOCUMENTS

| | | |
|---|---|---|
| CA | 873185 A1 | 6/1971 |

(Continued)

*Primary Examiner*—Gary E Elkins
(74) *Attorney, Agent, or Firm*—Womble Carlyle Sandridge & Rice, PLLC

(57) ABSTRACT

A carton having a dispenser with a removable dispenser panel. The dispenser panel is configured to be easily removed and to allow access to containers in the carton.

31 Claims, 5 Drawing Sheets

U.S. PATENT DOCUMENTS

| | | | | |
|---|---|---|---|---|
| 4,396,143 | A | 8/1983 | Killy | |
| 4,417,655 | A | 11/1983 | Forbes, Jr. | |
| 4,417,661 | A | 11/1983 | Roccaforte | |
| 4,577,762 | A | 3/1986 | Kuchenbecker | |
| 4,605,128 | A | 8/1986 | Rieke | |
| 4,658,984 | A | 4/1987 | Brunner | |
| 4,817,866 | A | 4/1989 | Wonnacott | |
| 4,890,440 | A | 1/1990 | Romagnoli | |
| 4,949,845 | A | 8/1990 | Dixon | |
| 4,974,771 | A | 12/1990 | Lavery | |
| 5,101,642 | A * | 4/1992 | Alexandrov | 62/371 |
| 5,137,211 | A | 8/1992 | Summer et al. | |
| 5,219,229 | A | 6/1993 | Sengewald | |
| 5,249,681 | A | 10/1993 | Miller | |
| 5,425,474 | A | 6/1995 | Dalea et al. | |
| 5,482,185 | A | 1/1996 | McNaughton | |
| 5,505,372 | A | 4/1996 | Edson et al. | |
| 5,577,612 | A | 11/1996 | Chesson et al. | |
| 5,597,114 | A | 1/1997 | Kramedjian et al. | |
| 5,622,309 | A | 4/1997 | Matsuda et al. | |
| 5,664,683 | A | 9/1997 | Brody | |
| 5,690,213 | A | 11/1997 | Matsumura | |
| 5,690,230 | A | 11/1997 | Griffith | |
| 5,794,778 | A | 8/1998 | Harris | |
| 5,826,783 | A | 10/1998 | Stout | |
| 5,875,961 | A | 3/1999 | Stone et al. | |
| 5,881,884 | A | 3/1999 | Podosek | |
| 5,921,398 | A | 7/1999 | Carroll | |
| 5,924,559 | A | 7/1999 | Carrel et al. | |
| 5,927,498 | A | 7/1999 | Saam | |
| 6,050,402 | A | 4/2000 | Walter | |
| 6,176,419 | B1 | 1/2001 | Holley, Jr. | |
| 6,283,293 | B1 | 9/2001 | Lingamfelter | |
| 6,409,077 | B1 | 6/2002 | Telesca et al. | |
| D459,927 | S | 7/2002 | Flowers et al. | |
| 6,478,219 | B1 | 11/2002 | Holley, Jr. | |
| 6,484,903 | B2 | 11/2002 | Spivey et al. | |
| 6,550,615 | B2 | 4/2003 | Lingamfelter | |
| 6,557,699 | B1 | 5/2003 | Focke et al. | |
| 6,578,736 | B2 | 6/2003 | Spivey | |
| 6,604,677 | B1 | 8/2003 | Sutherland et al. | |
| 6,669,083 | B2 | 12/2003 | Bates | |
| 6,715,639 | B2 | 4/2004 | Spivey | |
| 6,752,262 | B1 | 6/2004 | Boriani et al. | |
| 6,789,673 | B2 | 9/2004 | Lingamfelter | |
| 6,866,186 | B2 | 3/2005 | Fogle et al. | |
| 6,902,104 | B2 | 6/2005 | Holley, Jr. et al. | |
| 6,918,487 | B2 | 7/2005 | Harrelson | |
| 6,929,172 | B2 | 8/2005 | Bates et al. | |
| 6,968,992 | B2 * | 11/2005 | Schuster | 229/117.16 |
| 6,969,172 | B2 * | 11/2005 | Actis-Datta | 351/86 |
| 6,974,072 | B2 | 12/2005 | Harrelson | |
| 6,991,107 | B2 | 1/2006 | Harrelson | |
| 6,997,316 | B2 | 2/2006 | Sutherland | |
| 7,000,803 | B2 | 2/2006 | Miller | |
| 7,073,665 | B2 * | 7/2006 | Auclair et al. | 206/427 |
| 7,104,435 | B2 | 9/2006 | Holley, Jr. | |
| 7,134,593 | B2 | 11/2006 | Harrelson | |
| 7,225,930 | B2 | 6/2007 | Ford et al. | |
| 2002/0029991 | A1 | 3/2002 | Lingamfelter | |
| 2002/0070139 | A1 | 6/2002 | Bates | |
| 2002/0088820 | A1 | 7/2002 | Spivey | |
| 2002/0088821 | A1 | 7/2002 | Spivey et al. | |
| 2002/0185499 | A1 | 12/2002 | Harrelson et al. | |
| 2003/0141313 | A1 | 7/2003 | Bates | |
| 2003/0150759 | A1 | 8/2003 | White, Jr. | |
| 2003/0192907 | A1 | 10/2003 | Bates | |
| 2004/0040334 | A1 | 3/2004 | Rusnock | |
| 2004/0060972 | A1 | 4/2004 | Harrelson | |
| 2004/0089575 | A1 | 5/2004 | Lingamfelter | |
| 2004/0089671 | A1 | 5/2004 | Miller | |
| 2004/0099558 | A1 | 5/2004 | Oliff et al. | |
| 2004/0155098 | A1 | 8/2004 | Harrelson | |
| 2004/0188277 | A1 | 9/2004 | Auclair | |
| 2004/0188300 | A1 | 9/2004 | Sutherland | |
| 2004/0188508 | A1 | 9/2004 | Holley, Jr. et al. | |
| 2005/0023170 | A1 | 2/2005 | Lingamfelter | |
| 2005/0092820 | A1 | 5/2005 | Chekroune | |
| 2005/0115843 | A1 | 6/2005 | Harrelson | |
| 2005/0126947 | A1 | 6/2005 | Holley, Jr. | |
| 2005/0167291 | A1 | 8/2005 | Sutherland | |
| 2005/0189405 | A1 * | 9/2005 | Gomes et al. | 229/122 |
| 2006/0054522 | A1 | 3/2006 | Kline et al. | |
| 2006/0091193 | A1 * | 5/2006 | DeBusk et al. | 229/122.1 |
| 2006/0118606 | A1 | 6/2006 | Holley, Jr. et al. | |
| 2006/0131370 | A1 * | 6/2006 | Bates | 229/122 |
| 2006/0175386 | A1 | 8/2006 | Holley, Jr. | |

FOREIGN PATENT DOCUMENTS

| | | | |
|---|---|---|---|
| EP | 0 066 029 | A1 | 12/1992 |
| FR | 2 549 010 | | 1/1985 |
| GB | 2 264 101 | A | 8/1993 |
| GB | 0202809 | | 2/2002 |
| WO | WO 96/29260 | | 9/1996 |
| WO | WO 99/64301 | | 12/1999 |
| WO | WO 00/03937 | | 1/2000 |
| WO | WO 02/47990 | A2 | 6/2002 |
| WO | WO 02/47990 | A2 | 6/2002 |
| WO | WO 2004/043790 | A2 | 5/2004 |
| WO | WO 2005/051781 | A1 | 6/2005 |
| WO | WO 2006/050210 | A2 | 5/2006 |
| WO | WO 2006/050316 | A1 | 5/2006 |

* cited by examiner

CARTON WITH DISPENSER

CROSS-REFERENCE TO RELATED APPLICATION

This application claims the benefit of U.S. Provisional Application No. 60/815,977 which was filed on Jun. 23, 2006. The entire content of the above-referenced provisional application is hereby incorporated by reference as if presented herein in its entirety.

BACKGROUND OF INVENTION

The present invention generally relates to cartons for holding and dispensing articles.

SUMMARY OF THE INVENTION

In general, one aspect of the invention is directed to a carton for containing a plurality of articles. The carton comprises a plurality of panels that extends at least partially around an interior of the carton. The plurality of panels comprises a top panel, a bottom panel, a first side panel, and a second side panel. A dispenser is for allowing removal of articles from the carton. The dispenser comprises a dispenser panel that is at least partially defined by a tear line in the carton and is for being at least partially removed for at least further opening a dispenser opening. In the top panel, the tear line comprises a first lateral portion extending from proximate a first edge of the top panel to proximate a second edge of the top panel and a second lateral portion extending from proximate the first edge to proximate the second edge.

In another aspect, the invention is generally directed to a blank for forming a carton. The blank comprises a plurality of panels. The plurality of panels comprises a top panel, a bottom panel, a first side panel, and a second side panel. The blank comprises dispenser features comprising at least one dispenser panel that is at least partially defined by a tear line for at least partially separating the dispenser panel from the blank. In the top panel, the tear line comprises a first lateral portion extending from proximate a first edge of the top panel to proximate a second edge of the top panel, and a second lateral portion extending from proximate the first edge to proximate the second edge.

In yet another aspect, the invention is generally directed to a method of opening a carton. The method comprises providing a carton having a plurality of panels that extends at least partially around an interior of the carton. The plurality of panels comprises a top panel, a bottom panel, a first side panel, a second side panel, a dispenser comprising a dispenser panel at least partially defined by a tear line in the carton and an access flap in at least one of the first side panel and the second side panel. The tear line comprises a first lateral portion extending from proximate a first edge of the top panel to proximate a second edge of the top panel, and a second lateral portion extending from proximate the first edge to proximate the second edge. The method further comprising pivoting the access flap to allow access to the dispenser panel and grasping the dispenser panel and at least partially separating the dispenser panel from the carton by at least partially tearing the carton along the first and second lateral portions to create a dispenser opening in the carton.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWINGS

Corresponding parts are designated by corresponding reference numbers throughout the drawings.

DETAILED DESCRIPTION OF THE EXEMPLARY EMBODIMENT

The present invention generally relates to cartons housing a plurality of articles and a dispenser in the carton for removing articles from the carton. The present invention can be used, for example, in cartons that contain articles or other products such as, for example, food and beverages or pet food. The articles can also include soup cans or other food or beverage containers such as, for example, cans, bottles, PET containers, or other containers such as those used in packaging foodstuffs. For the purposes of illustration and not for the purpose of limiting the scope of the present invention, the following detailed description describes generally cylindrical containers as disposed within the carton embodiments. In this specification, the relative terms "lower," "bottom," "upper" and "top" indicate relative orientations determined in relation to fully erected cartons.

Figure 1:
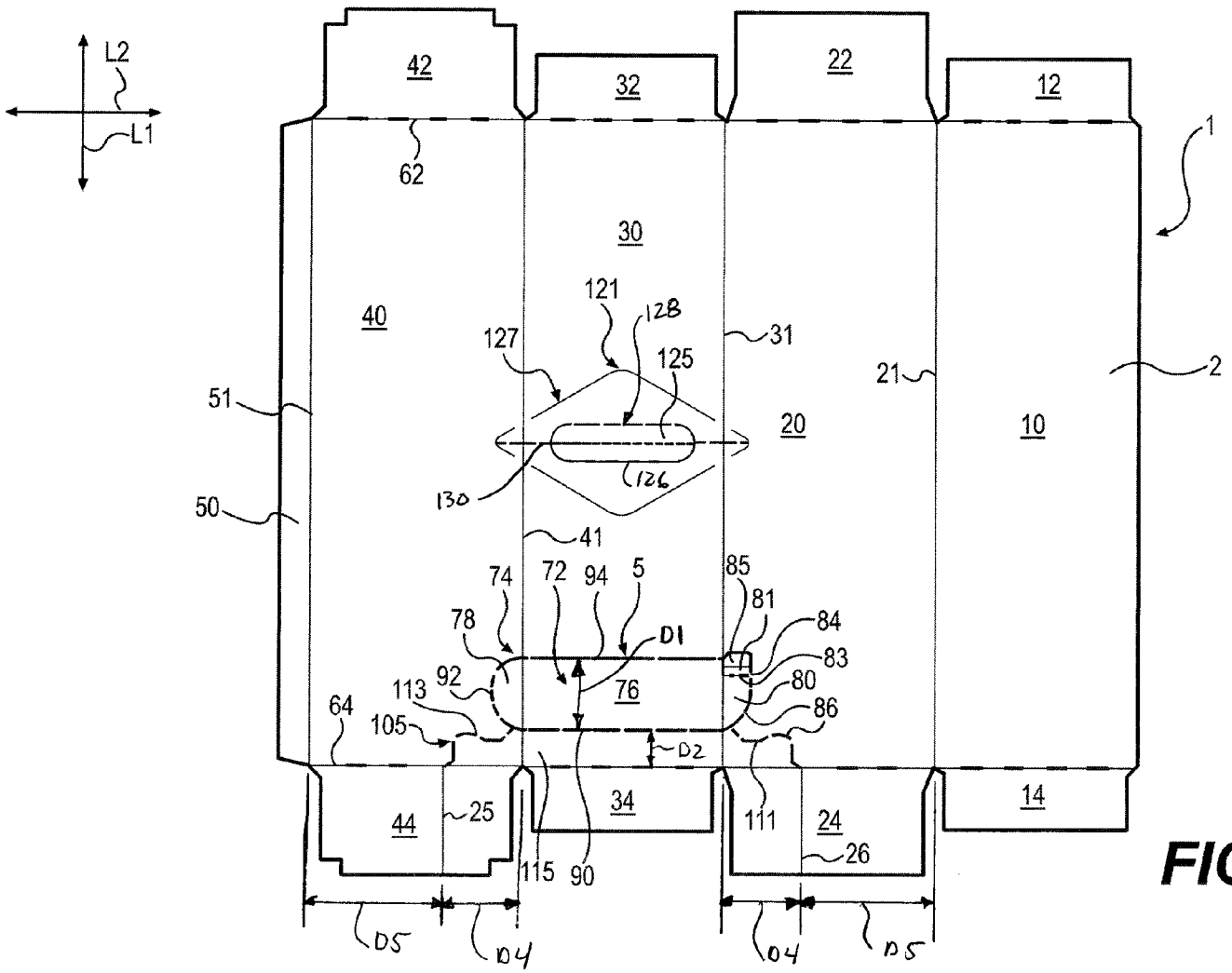
FIG. 1 is a plan view of a blank from which a carton according to an exemplary embodiment of this invention is formed.
Figure 2:
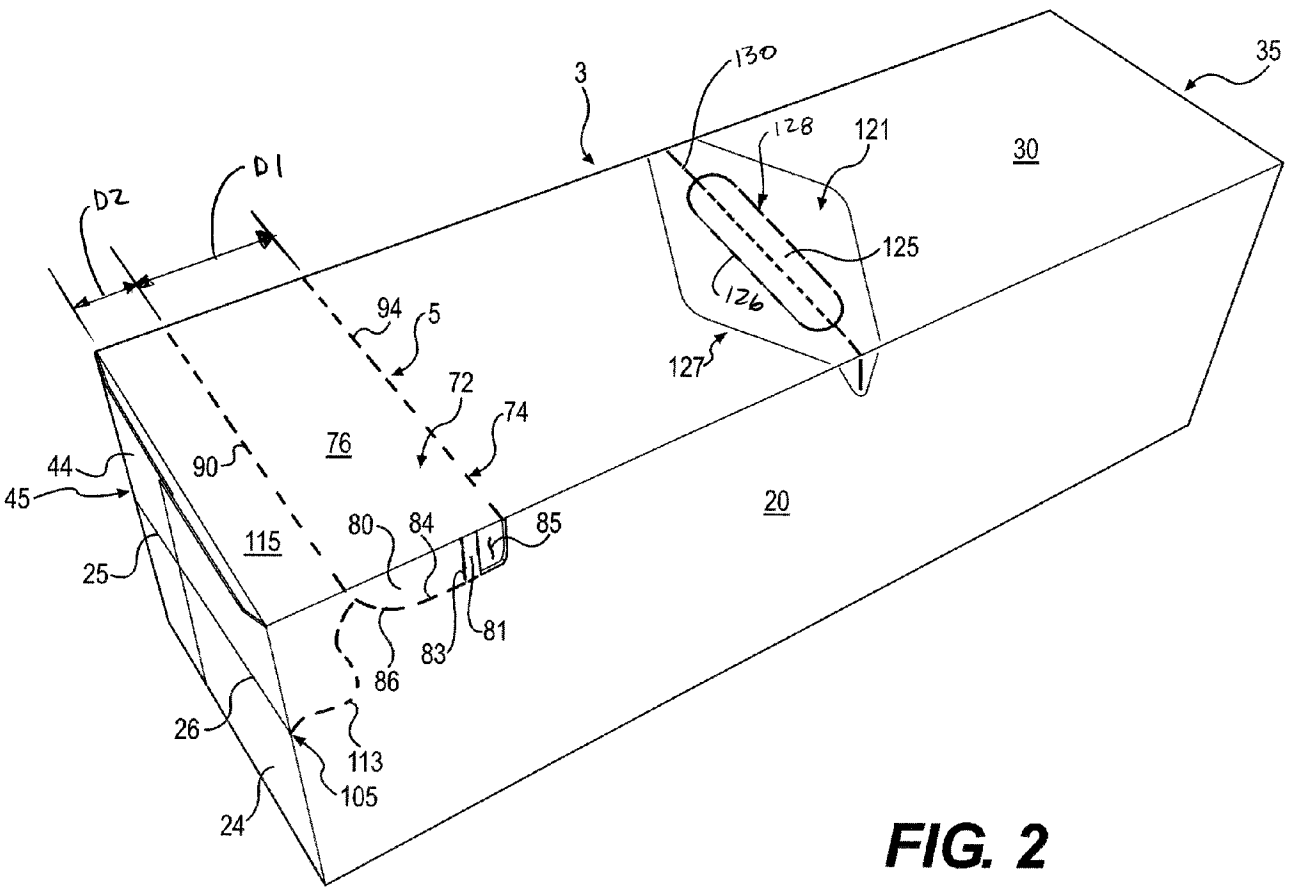
FIG. 2 is a perspective of the carton formed of the blank of FIG. 1.
Figure 4:
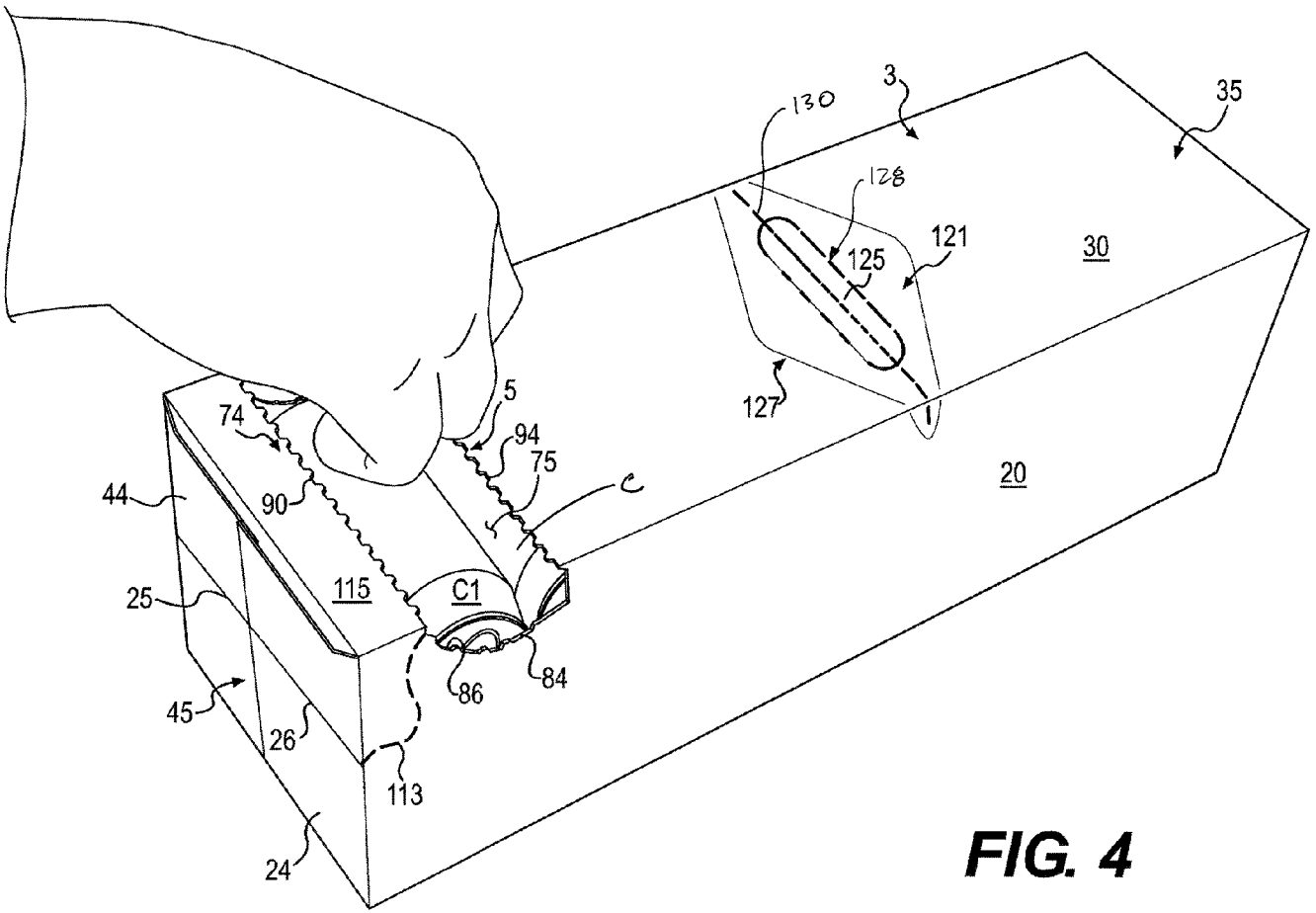
FIG. 4 is a perspective similar to FIG. 2 but showing further removal of the dispenser panel.
Figure 5:
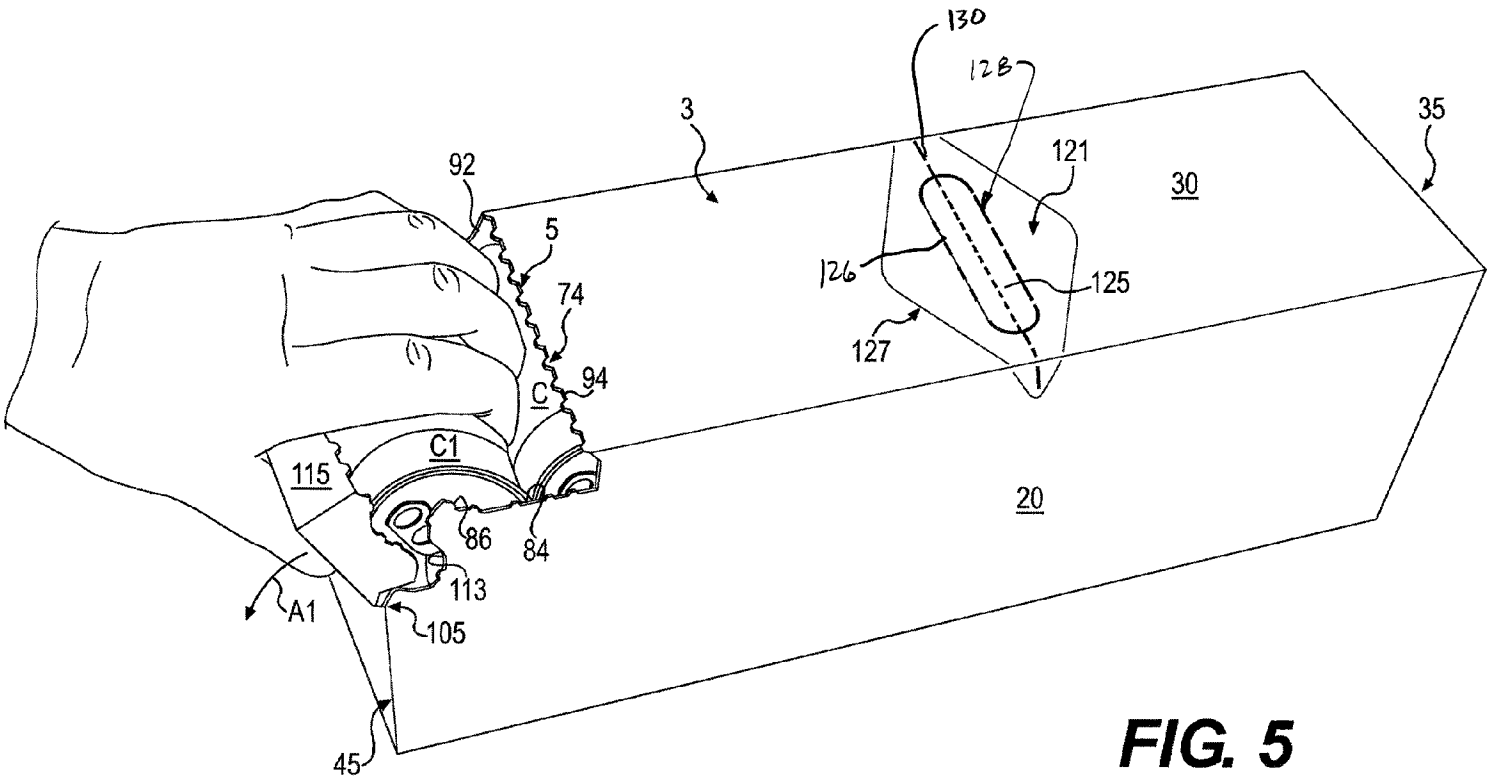
FIG. 5 is a perspective similar to FIG. 4 but showing removal of a container from the carton.

FIG. 1 is a plan view of the exterior side 2 of a blank, generally indicated at 1, used to form a carton 3 according to the exemplary embodiment of the invention. The carton 3 can be used to house a plurality of articles such as containers C (FIGS. 4 and 5). The carton 3 has a dispenser, generally indicated at 5, formed in the carton for allowing access to the containers C. In the illustrated embodiment, the carton 3 is sized to hold twelve containers C arranged in a single layer in a 2×6 arrangement, but it is understood that the carton 3 may be sized and shaped to hold containers C of a different or same quantity in more than one layer and/or in different row/column arrangements (e.g., 1×12, 3×6, 2×6×2, 3×4×2, etc.)

The blank 1 has a longitudinal axis L1 and a lateral axis L2. In the illustrated embodiment, the blank 1 comprises a bottom panel 10 foldably connected to a first side panel 20 at a first longitudinal fold line 21, a top panel 30 foldably connected to the first side panel 20 at a second longitudinal fold line 31, and a second side panel 40 foldably connected to the top panel 30 at a third longitudinal fold line 41. An adhesive flap 50 is foldably connected to the bottom panel 10 at a fourth longitudinal fold line 51.

The bottom panel 10 is foldably connected to a first bottom end flap 12 and a second bottom end flap 14. The first side panel 20 is foldably connected to a first side end flap 22 and a second side end flap 24. The top panel 30 is foldably connected to a first top end flap 32 and a second top end flap 34. The second side panel 40 is foldably connected to a first side end flap 42 and a second side end flap 44. When the carton 3 is erected, the top and bottom end flaps 12 and 32 and side end flaps 22 and 42 close a first end 35 of the carton, and the top and bottom end flaps 14 and 34 and side end flaps 24 and 44 close a second end 45 of the carton. In accordance with an alternative embodiment of the present invention, different flap arrangements can be used for closing the ends 35, 45 of the carton.

The top and bottom end flaps 12 and 32 and side end flaps 22 and 42 extend along a first marginal area of the blank 1, and can be foldably connected at a first lateral fold line 62 that extends along the width of the blank. The top and bottom end flaps 14 and 34 and side end flaps 24 and 44 extend along a second marginal area of the blank 1, and can be foldably connected at a second lateral fold line 64 that also extends along the width of the blank. The lateral fold lines 62, 64 may be, for example, substantially straight, or offset at one or more locations to account for blank thickness or for other factors. In the illustrated embodiment, the side end flaps 24, 44 each have a respective longitudinal fold line 25, 26 extending from the lateral fold line 64 to the edge of the flap.

The dispenser 5 includes a dispenser panel, generally indicated at 72, removably attached to the blank 1 at a tear line, generally indicated at 74. When the dispenser panel 72 is removed from the carton 3, a dispenser opening 75 (FIGS. 4 and 5) is exposed that allows the containers C to be selectively dispensed from the carton. In the illustrated embodiment, the dispenser panel 72 includes a first portion 76 in the top panel 30 of the blank 1, a second portion 78 in the side panel 40, and a third portion 80 in the side panel 20. The dispenser panel 72 includes a access flap 81 foldably attached to the third portion 80 at a lateral fold line 83. The dispenser 5 includes an access opening 85 in the side panel 20 for grasping the flap 81 to initiate removal of the dispenser pane 72 from the carton 3. Alternatively, the access flap 81 could be sized to cover the access opening 85 so that the dispenser is activated by first folding the access flap or the access opening could be otherwise shaped and located. Alternatively, removal of the dispenser panel 72 can be initiated without the access opening 85 and/or flap 81, which may be omitted.

In the illustrated embodiment, the tear line 74 includes a first portion 84 extending in the longitudinal direction in the side panel 20 from the access opening 85 to a curved second portion 86 of the tear line, with the second portion extending from the first portion to the longitudinal fold line 31. The tear line 74 includes a third portion 90 extending in the lateral direction in the top panel 30 between the longitudinal fold line 31 and the longitudinal fold line 41. A fourth portion 92 of the tear line 74 extends from the intersection of the third portion 90 with the longitudinal fold line. The fourth portion 92 of the tear line 74 is curved and extends laterally away from the longitudinal fold line 41 into the side panel 40 and extends laterally back to the longitudinal fold line 41. In the illustrated embodiment, the fourth portion 92 is generally semicircular in shape but it is understood that it may be otherwise shaped without departing from the scope of this invention. The tear line 74 includes a fifth portion 94 extending generally in the lateral direction in the top panel 30 between the intersection of the fourth portion 92 with the longitudinal fold line 41 to the access opening 85 in the side panel 20.

In the illustrated embodiment, the fifth portion 94 of the tear line 74 is generally parallel to the third portion 90 and is spaced apart from the third portion by a distance D1. Also, the lateral portion 90 of the tear line 74 is spaced apart from the lateral fold line 64 a distance D2. It is understood that the distance D1 is less than the diameter of the containers although the tear line 74 may be otherwise sized and shaped without departing from the scope of this invention. In one embodiment, the distance D1 is in the range of approximately 25 percent to approximately 90 percent of the diameter of the containers C, and the distance D2 is in the range of approximately 10 percent to approximately 75 percent of the diameter of the containers.

In the illustrated embodiment, the blank 1 includes a hinge, generally designated 105, that allows the dispenser opening 75 to be expanded to facilitate access to the container C in the carton 3. The hinge 105 includes a first curved tear line 111 in the blank 1 that extends from the second portion 86 of the tear line 74 to the intersection of the lateral fold line 64 and the longitudinal fold line 26 in the side end flap 24. A second curved tear line 113 extends from the fourth portion 92 of the tear line 74 in the second side panel 40 to the intersection of the lateral fold line 64 with the longitudinal fold line 25 in the side end flap 44. In the illustrated embodiment, the intersection of each of the first and second curved tear lines 111, 113 with the lateral fold line 64 is spaced apart from a respective fold line 31, 41 a distance D4. The intersection of each of the first and second curved tear lines 111, 113 with the lateral fold line 64 is spaced apart from a respective fold line 21, 51 a distance D5. In the illustrated embodiment, the fold lines 25, 26 are respectively aligned with the intersections of the curved tear lines 111, 113 with the lateral fold line 64 so that the fold lines 25, 26 are spaced from the fold lines 31, 41 by the distance D4 and the fold lines 25, 26 are respectively spaced from the fold lines 21, 51 by the distance D5. The fold lines 25, 26 could be alternative spaced and arranged, or could be omitted, without departing from the invention.

In the illustrated embodiment, the first and second curved tear lines 111, 113, respective portions of the second and fourth portions 86, 92 of the tear line 74, and the third portion 90 of the tear line define a pivotable flap 115 of the carton 3. The pivotable flap 115 includes a portion of the first side panel 20, a portion of the top panel 30, a portion of the second side panel 40, and portions of the end flaps 24, 44, 34 forming the closed end 45 of the carton 3. As will be discussed in more detail below, the pivotable flap 115 is generally pivotable at the closed end of the carton 3 about the fold lines 25, 26 of the overlapped side end flaps 24, 44 forming the closed end 45 of the carton to expand the dispenser opening 75. The fold lines 25, 26 may be straight, curved, or otherwise shaped without departing from the scope of this invention. Further, the blank 1 may include tear lines (not shown) in the side end flaps 24, 44 to facilitate removal of the pivotable flap 115 from the carton 3 without departing from the scope of this invention. In the illustrated embodiment, the tear lines 111, 115 are curved but it is understood that the tear lines may be otherwise shaped (e.g., straight, oblique, L-shaped, etc.) without departing from the scope of this invention.

In the illustrated embodiment, the blank 1 includes a handle generally designated 121 in the top panel 30. The handle 121 can be any type of suitable conventional handle. In the illustrated embodiment, the handle comprises an elongate handle flap 125 formed in the top panel 30 and a diamond-shaped crease 127 in the top panel and the first and second side panels 20, 40. The handle flap 125 is foldably attached to the top panel 30 at lateral fold line 126 and is defined by a tear line 128. A lateral fold line 130 bisects the handle flap 125 and diamond-shaped crease 127 and extends across the top panel 30 and into both the side panels 20, 40 to facilitate activation of the handle 121. The handle 121 may be activated by pressing on the handle flap 125 and folding the handle flap down (e.g., inward) to form an opening (not shown) in the carton 3. The opening is shaped for insertion of a user's fingers during grasping of the carton 3. The handle 121 is longitudinally spaced in the top panel 30 such that the handle flap 125 is generally centered in the top panel between the lateral fold lines 62, 64 of the blank. It is understood that the handle 121 may be otherwise shaped and otherwise located without departing from the scope of this invention. For example, the handle 121 may be located in the top panel closer to the closed end 35 to facilitate grasping of the carton via at a location closer to the closed end. Furthermore, the handle 121 can be omitted from the carton 3 without departing from the invention. In one embodiment, portions (e.g., end portions extending from respective edges of the handle flap 125) of the lateral fold line 130 can be tear lines to facilitate activation of the handle 121. Also, the fold line 130 can be a tear line that divides the handle flap 125 into two portions each being foldably attached to the top panel 30.

As shown in FIG. 1, the distance D1 is at least approximately 1.7 inches (43 mm), the distance D2 is at least approximately 0.8 inches (20 mm), and the diameter of the containers C is at least approximately 2½ inches (63 mm). As shown in FIG. 1, the distance D4 may be in the range of approximately 10% of the diameter of the containers C to approximately 200% of the diameter of the containers. The distance D5 may in the range of approximately 10% of the diameter of the containers C to approximately 200% of the diameter of the containers. In the embodiment of FIG. 1, the distance D4 is at least approximately 1.9 inches (48 mm) and the distance D5 is at least approximately 2.9 inches (74 mm). It is understood that the dimensional information provided herein is exemplary only, may be more or less than the dimensions listed herein, and is not intended to limit the scope of the invention.

In accordance with the exemplary embodiment, the blank 1 can be erected into the carton 3 by folding along fold lines 21, 31, 41, 51 and adhering the adhesive flap 50 to the bottom panel 10. The ends 35, 45 of the carton 3 can be closed by respectively overlapping and adhering the top and bottom end flaps 12, 32, 14, 34 and side end flaps 22, 42, 24, 44 after the containers C are inserted into the carton. Alternatively, one of the ends 35, 45 can be closed before inserting the containers C into the carton 3 and the other of the ends can be closed after inserting the containers in the carton. It is understood that closing configurations that differ than the closing configurations discussed herein are within the scope of the invention.

Figure 3:
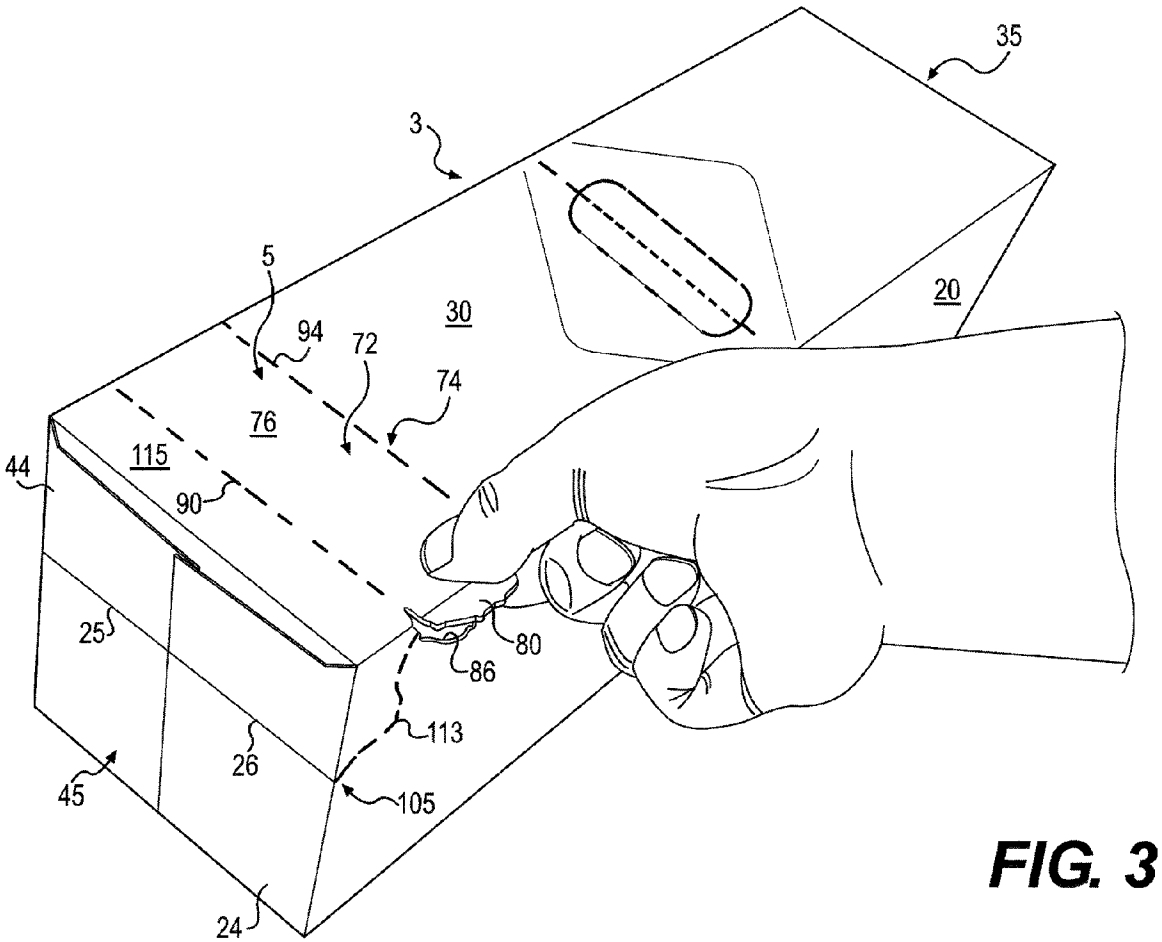
FIG. 3 is a perspective similar to FIG. 2 but showing a dispenser panel partially removed.

As shown in FIGS. 3 and 4, the dispenser panel 72 may be removed from the carton 3 to form the dispenser opening 75. An exemplary opening process can begin with grasping the flap 81 via the access opening 85 in the side panel 20 and tearing the dispenser panel 72 along the tear line 74. After separation and removal of the dispenser panel 72, the container C1 adjacent the closed end 1 of the carton 3 is restricted from being dispensed through the dispenser opening of the carton 3 by the portion of the top panel 30 forming the pivotable flap 115. Referring to FIG. 5, to remove the container C1, the container is grasped and pulled in the direction of arrow A1 to pivot the pivotable flap 115 about the fold lines 25, 26 to effectively increase the size of the dispenser opening 75 so that the end container may be removed from the carton 3. It is understood that after pivoting the pivotable flap 115, the remaining containers C can be selectively removed from the carton 3 by removal through the dispenser opening 75. Alternatively, the pivotable flap 115 may be removed from the carton without departing from the scope of this invention.

The present invention can be used in cartons that include various features, including additional opening features that provide easy access to the articles, and tilt features that position the articles at the front or rear end of the carton.

The blank according to the present invention can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described above. The blank can also be laminated to or coated with one or more sheet-like materials at selected panels or panel sections.

In accordance with the above-described embodiments of the present invention, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line or other line of disruption.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present invention for each of the tear lines to be replaced with a continuous slit, or the like. For example, a cut line can be a continuous slit or could be wider than a slit without departing from the present invention.

The above embodiments may be described as having one or more panels adhered together by glue during erection of the carton embodiments. The term "glue" is intended to encompass all manner of adhesives commonly used to secure carton panels in place.

The foregoing description of the invention illustrates and describes various embodiments of the present invention. As various changes could be made in the above construction without departing from the scope of the invention, it is intended that all matter contained in the above description or shown in the accompanying drawings shall be interpreted as illustrative and not in a limiting sense. Furthermore, the scope of the present invention covers various modifications, combinations, alterations, etc., of the above-described embodiments that are within the scope of the claims. Additionally, the disclosure shows and describes only selected embodiments of the invention, but the invention is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the invention without departing from the scope of the invention.

What is claimed is:

1. A carton in combination with a plurality of articles, the plurality of articles comprising containers having a diameter, the carton comprising:

a plurality of panels that extends at least partially around an interior of the carton, the plurality of panels comprises a top panel, a bottom panel, a first side panel, and a second side panel;

at least two end flaps respectively foldably attached to respective panels of the plurality of panels, wherein the end flaps at least partially close an end of the carton, a dispenser for allowing removal of articles from the carton, the dispenser comprising a dispenser panel that is at least partially defined by a tear line in the carton and is for being at least partially removed for at least further opening a dispenser opening, the dispenser opening being for removing articles from the carton, in the top panel, the tear line comprising a first lateral portion extending from proximate a first edge of the top panel to proximate a second edge of the top panel and a second lateral portion extending from proximate the first edge to proximate the second edge, the first and second lateral portions of the tear line being respectively spaced apart from a third edge and a fourth edge of the top panel to define respective edges of the dispenser panel; and the dispenser comprises a hinge and a pivotable flap adjacent the dispenser opening, the pivotable flap being pivotable at the hinge to expand the dispenser opening, the pivotable flap comprising at least a portion of the top panel, at least a portion of at least one of the first side panel and the second side panel, and at least a portion of the closed end, the hinge comprising at least one fold line in the at least two end flaps, the at least one fold line being spaced apart from the bottom panel by a first minimum distance and being spaced apart from the top panel by a second minimum distance, the first minimum distance being greater than the second minimum distance, the first and second lateral portions of the tear line being spaced apart a first distance corresponding to a width of the dispenser panel, and the first lateral portion of the tear line being spaced apart from one of a third edge and a fourth edge of the top panel by a second distance corresponding to a width of the pivotable flag in the top panel, the sum of the first distance and the second distance being approximately equal to the diameter of the containers.

2. The carton of claim 1 wherein at least one of the first lateral portion and the second lateral portion extends substantially all the way to each of the first edge and the second edge.

3. The carton of claim 2 wherein the first lateral portion and the second lateral portion intersect each of the first edge and the second edge.

4. The carton of claim 1 wherein the tear line further comprises a first curved portion in the first side panel.

5. The carton of claim 4 wherein the tear line further comprises a second curved portion in the second side panel.

6. The carton of claim 5 wherein the dispenser panel comprises at least a portion of the top panel, at least a portion of the first side panel, and at least a portion of the second side panel.

7. The carton of claim 1 wherein the dispenser panel comprises a fold line in at least one of the first side panel and the second side panel at least partially defining an access flap for initiating removal of the dispenser panel.

8. The carton of claim 7 wherein the dispenser further comprises an access opening in the at least one side panel, the access opening is adjacent the access flap for grasping the dispenser panel.

9. The carton of claim 1 wherein the pivotable flap comprises a portion of the first side panel and a portion of the second side panel, the hinge comprises a curved tear line in each of the first side panel and the second side panel for separating the pivotable flap from the first and second side panels.

10. The carton of claim 9 wherein the end flaps comprise a top end flap foldably attached to the top panel and side end flaps respectively foldably attached to the side end panels, the pivotable flap comprises at least a portion of the top end flap.

11. The carton of claim 10 wherein the pivotable flap comprises at least a portion of at least one of the side end flaps.

12. The carton of claim 1 wherein the first edge and the second edge of the top panel are longitudinal edges, and the third edge and fourth edge of the top panel are lateral edges.

13. The carton of claim 12 wherein the first lateral portion is spaced apart from the third edge of the top panel by a first distance and the second lateral portion is spaced apart from third edge of the top panel by a second distance, the first distance being less than the second distance.

14. The carton of claim 1 in combination with the plurality of articles, the plurality of articles comprising containers having a diameter, wherein the first lateral portion is spaced apart from the second lateral portion by a distance, the distance being greater than half the diameter of the containers.

15. A blank for forming a carton for holding a plurality of articles, the plurality of articles comprising containers having a diameter, the blank comprising:

a plurality of panels, the plurality of panels comprises a top panel, a bottom panel, a first side panel, and a second side panel;

at least two end flaps respectively foldably attached to respective panels of the plurality of panels, wherein the end flaps are for at least partially closing an end of the carton when the carton is formed from the blank, and dispenser features comprising at least one dispenser panel that is at least partially defined by a tear line for at least partially separating the dispenser panel from the blank and is for being at least partially removed for at least further opening a dispenser opening in the carton formed from the blank, the dispenser opening being for removing articles from the through the top panel of the carton;

in the top panel, the tear line comprises a first lateral portion extending from proximate a first edge of the top panel to proximate a second edge of the top panel, and a second lateral portion extending from proximate the first edge to proximate the second edge, the first and second lateral portions of the tear line being respectively spaced apart from a third edge and a fourth edge of the top panel to define respective edges of the dispenser panel, and the dispenser comprises expansion features including a hinge and a pivotable flap adjacent the dispenser opening, the pivotable flap being pivotable at the hinge to enlarge the dispenser opening, the pivotable flap comprising at least a portion of the top panel, at least a portion of at least one of the first side panel and the second side panel, and at least a portion of the closed end, the hinge comprising at least one fold line in the at least two end flaps, the at least one fold line being spaced apart from the bottom panel by a first minimum distance and being spaced apart from the top panel by a second minimum distance, the first minimum distance being greater than the second minimum distance, the first and second lateral portions of the tear line being spaced apart a first distance corresponding to a width of the dispenser panel, and the first lateral portion of the tear line being spaced apart from one of the third edge and the fourth edge of the top panel by a second distance corresponding to a width of the pivotable flap in the top panel, the sum of the first distance and the second distance being approximately equal to the diameter of the containers.

16. The blank of claim 15 wherein the first lateral portion and second lateral portion intersect each of the first edge and the second edge.

17. The blank of claim 15 wherein the tear line further comprises a first curved portion in the first side panel and a second curved portion in the second side panel.

18. The blank of claim 17 wherein the dispenser panel comprises at least a portion of the top panel, at least a portion of the first side panel, and at least a portion of the second side panel.

19. The blank of claim 15 wherein the dispenser panel comprises a fold line in at least one of the first side panel and the second side panel at least partially defining an access flap of the dispenser panel.

20. he blank of claim 19 wherein the dispenser features further comprise an access opening in the at least one side panel, the access opening is adjacent the access flap.

21. The blank of claim 15 wherein the hinge comprises a curved tear line in each of the first side panel and the second side panel.

22. The blank of claim 21 wherein the pivotable flap comprises at least a portion of the first side panel, and at least a portion of the second side panel.

23. The blank of claim 22 wherein the at least two end flaps are respectively foldably attached to respective panels of the plurality of panels, wherein the end flaps comprise a top end flap foldably attached to the top panel and side end flaps respectively foldably attached to the side end panels, the pivotable flap comprises at least a portion of the top end flap.

24. A method of opening a carton containing a plurality of containers, the method comprising:

providing a carton having a plurality of panels that extends at least partially around an interior of the carton, the plurality of panels comprises a top panel, a bottom panel, a first side panel, a second side panel, at least two end flaps respectively foldably attached to respective panels of the plurality of panels, wherein the end flaps at least partially close an end of the carton, a dispenser comprising a dispenser panel at least partially defined by a tear line in the carton and an access flap in at least one of the first side panel and the second side panel, the tear line comprising a first lateral portion extending from proximate a first edge of the top panel to proximate a second edge of the top panel, and a second lateral portion extending from proximate the first edge to proximate the second edge, the first and second lateral portions being respectively spaced apart from a third edge and a fourth edge of the top panel, the dispenser comprises a hinge and a pivotable flap adjacent the dispenser opening, the pivotable flap comprising at least a portion of the top panel, at least a portion of at least one of the first side panel and the second side panel, and at least a portion of the closed end, the hinge comprising at least one fold line in the at least two end flaps, the at least one fold line being spaced apart from the bottom panel by a first minimum distance and being spaced apart from the top panel by a second minimum distance, the first minimum distance being greater than the second minimum distance;

pivoting the access flap to allow access to the dispenser panel;

grasping the dispenser panel and separating the dispenser panel from the carton by tearing the carton along the first and second lateral portions to create a dispenser opening in the carton, the tearing along the first and second lateral portions defining respective spaced apart edges of the dispenser opening in the top panel;

expanding the dispenser opening by grasping an end container that is adjacent to the end of the carton and pivoting the pivotable flap together with the end container at the hinge to increase the size of the dispenser opening; and removing the end container from the carton through the dispenser opening, the removing comprising removing the end container through the top panel.

25. The method of claim 24 wherein the hinge is formed by a curved tear line in each of the first side panel and the second side panel, and wherein the pivoting of the pivotable flap comprises separating the pivotable flap from the first side panel and the second side panel along the curved tear lines.

26. The method of claim 24 wherein the pivoting of the pivotable flap comprises pivoting the pivotable flap about a fold line in the closed end of the carton.

27. A carton in combination with a plurality of articles, the plurality of articles comprising containers having a diameter, the carton comprising:

a plurality of panels that extends at least partially around an interior of the carton, the plurality of panels comprises a top panel, a bottom panel, a first side panel, and a second side panel;

a dispenser for allowing removal of articles from the carton, the dispenser comprising a dispenser panel that is at least partially defined by a tear line in the carton and is for being at least partially removed for at least further opening a dispenser opening, the dispenser opening being for removing articles from the carton, the dispenser comprises a hinge and a pivotable flap adjacent the dispenser opening, the pivotable flap being pivotable at the hinge to enlarge the dispenser opening, the pivotable flap comprising at least a portion of the top panel, at least a portion of the first side panel, and at least a portion of the second side panel, the hinge comprising a curved tear line in each of the first side panel and the second side panel for separating the pivotable flap from the first and second side panels, in the top panel, the tear line comprising a first lateral portion extending from proximate a first edge of the top panel to proximate a second edge of the top panel and a second lateral portion extending from proximate the first edge to proximate the second edge, the first and second lateral portions of the tear line being spaced apart a first distance corresponding to a width of the dispenser panel, and the first lateral portion of the tear line being spaced apart from one of a third edge and a fourth edge of the top panel by a second distance corresponding to a width of the pivotable flap in the top panel, the first distance being greater than the second distance, the sum of the first distance and the second distance being approximately equal to the diameter of the containers.

28. The carton of claim 27 wherein the carton comprises at least two end flaps respectively foldably attached to respective panels of the plurality of panels, the end flaps comprises side end flaps respectively foldably attached to the first side panel and the second side panel, wherein the side end flaps at least partially close an end of the carton, the pivotable flap comprising at least a portion of each of the side end flaps.

29. The carton of claim 28 wherein the hinge comprises a fold line in the end of the carton extending across the side end flaps, the pivotable flap being pivotable at the fold line.

30. The carton of claim 27 wherein the first edge and the second edge of the top panel are longitudinal edges, and the third edge and fourth edge of the top panel are lateral edges.

31. The carton of claim 29 wherein the curved tear line in the first side panel intersects the fold line in the side end flaps at a first intersection and the curved tear line in the second side panel intersects the fold line in the side end flaps at a second intersection, the first intersection and the second intersection form a lowermost point of the pivotable flap that is spaced vertically below the top panel at the end of the carton by a third distance, the third distance being less than half of a maximum vertical height of the carton.

* * * * *